US012359558B2

(12) United States Patent
AlQatari et al.

(10) Patent No.: US 12,359,558 B2
(45) Date of Patent: Jul. 15, 2025

(54) METHOD AND SYSTEM FOR DETECTING AND PREDICTING SANDING AND SAND SCREEN DEFORMATION

(71) Applicant: SAUDI ARABIAN OIL COMPANY, Dhahran (SA)

(72) Inventors: Ammar AlQatari, Dhahran (SA); Murtadha J. AlTammar, Dhahran (SA); Khalid Mohammed Alruwaili, Dammam (SA); Mustafa Hassan Alaliwat, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 707 days.

(21) Appl. No.: 17/655,916

(22) Filed: Mar. 22, 2022

(65) Prior Publication Data

US 2023/0304393 A1 Sep. 28, 2023

(51) Int. Cl.

| | |
|---|---|
| ***E21B 47/06*** | (2012.01) |
| ***E21B 34/02*** | (2006.01) |
| *E21B 43/08* | (2006.01) |

(52) U.S. Cl.

CPC ..... *E21B 47/06* (2013.01); *E21B 34/025* (2020.05); *E21B 43/08* (2013.01); *E21B 2200/20* (2020.05); *E21B 2200/22* (2020.05)

(58) Field of Classification Search

CPC ..... E21B 47/06; E21B 34/025; E21B 43/08; E21B 2200/20; E21B 2200/22

See application file for complete search history.

(56) References Cited

U.S. PATENT DOCUMENTS

| | | | |
|---|---|---|---|
| 6,857,476 | B2 | 2/2005 | Richards |
| 7,653,488 | B2 | 1/2010 | Mese et al. |

(Continued)

FOREIGN PATENT DOCUMENTS

| | | | |
|---|---|---|---|
| EP | 2378058 | A2 | 10/2011 |
| WO | 2019038401 | A1 | 2/2019 |
| WO | 2021/052602 | A1 | 3/2021 |

OTHER PUBLICATIONS

Meira, Ronald E. et al., "Prediction of Sand Transport in Horizontal and Inclined Flow Based on Machine Learning Algorithms"; Proceedings of the PSIG Annual Meeting; Paper No. PSIG-2109; pp. 1-12; May 3, 2021 (12 pages).

(Continued)

*Primary Examiner* — Ricky Go

(74) *Attorney, Agent, or Firm* — Osha Bergman Watanabe & Burton LLP

(57) ABSTRACT

A method involves obtaining a current production rate, obtaining a current wellhead pressure, computing a current smoothed production rate from the current production rate, computing a current smoothed wellhead pressure from the current wellhead pressure, predicting based on the current smoothed production rate, the current smoothed wellhead pressure, and the current surface choke size, a future smoothed production rate and a future smoothed wellhead pressure, computing a change of the future vs the current smoothed production rate, and computing a change of the future vs the current smoothed wellhead pressure. The method further involves comparing the change of the future vs the current smoothed production rate against a first pre-specified threshold production rate derivative, comparing the change of the future vs the current smoothed wellhead pressure against a first pre-specified threshold wellhead (Continued)

pressure derivative, and based on an outcome of the comparison, determining whether future sanding is detected.

20 Claims, 10 Drawing Sheets

(56) References Cited

U.S. PATENT DOCUMENTS

| | | | | |
|---|---|---|---|---|
| 7,660,670 | B2 | 2/2010 | Drebit et al. | |
| 7,711,486 | B2 | 5/2010 | Thigpen et al. | |
| 8,622,128 | B2 | 1/2014 | Hegeman | |
| 11,593,683 | B2 * | 2/2023 | Cerrahoğlu | G06N 20/00 |
| 2018/0051549 | A1 | 2/2018 | Holyfield | |
| 2021/0087923 | A1 | 3/2021 | Thiruvenkatanathan | |
| 2021/0109252 | A1 | 4/2021 | Li | |
| 2021/0397994 | A1 | 12/2021 | Cerrahoglu et al. | |
| 2023/0196089 | A1 * | 6/2023 | Liu | E21B 49/00 706/12 |
| 2023/0235644 | A1 * | 7/2023 | Martin | E21B 34/08 703/10 |
| 2024/0384628 | A1 * | 11/2024 | Mendez Martinez | E21B 47/06 |

OTHER PUBLICATIONS

Moreno, Ferney Geovany et al., "Application of Critical Drawdown Pressure Prediction in Completion Design to Minimize Sanding in a Clastic Gas Reservoir in Saudi Arabia"; Proceedings of the SPE Kingdom of Saudi Arabia Annual Technical Symposium and Exhibition; Paper No. SPE-188088-MS; pp. 1-12; Apr. 24, 2017 (12 pages).

Al Shehri, Fahad Hassan et al., "Utilizing Machine Learning Methods to Estimate Flowing Bottom-Hole Pressure in Unconventional Gas Condensate Tight Sand Fractured Wells in Saudi Arabia"; Proceedings of the SPE Russian Petroleum Technology Conference; Paper No. SPE-201939-MS; pp. 1-12; Oct. 26, 2020 (12 pages).

Ngwashi, Afungchwi Ronald et al., "Evaluation of Machine-Learning Tools for Predicting Sand Production"; Proceedings of the SPE Nigeria Annual International Conference and Exhibition; Paper No. SPE-207193-MS; pp. 1-16; Aug. 2, 2021 (16 pages).

Altammar, Murtadha J. et al., "Coil Tubing Fill Cleanout Implemented on Plugged Stand Alone Screens: Highly Successful Campaign in Saudi Arabian Gas Producers"; Proceedings of the SPE Saudi Arabia Section Technical Symposium and Exhibition; Paper No. SPE-160838-MS; pp. 1-12; Apr. 8, 2012 (12 pages).

Mahmoudi, Mahdi et al., "Standalone Sand Control Failure: Review of Slotted Liner, Wire Wrap Screen, and Premium Mesh Screen Failure Mechanism"; Proceedings of the 2018 SPE Annual Technical Conference and Exhibition; Paper No. SPE-191553-MS; pp. 1-27; Sep. 24, 2018 (27 pages).

Lee, C. A. et al., "Evaluation of Screen Integrity in Horizontal Open-Hole Screen Completions—A Numerical Approach"; Proceedings of the 42nd U.S. Rock Mechanics Symposium (USRMS); Paper No. ARMA-08-262; Jun. 29, 2008 (11 pages).

Khamehchi, Ehsan et al., "A novel approach to sand production prediction using artificial intelligence"; Journal of Petroleum Science and Engineering; vol. 123; pp. 147-154; Nov. 2014 (8 pages).

Office Action issued by the Saudi Arabian patent office for corresponding Saudi Arabian patent application No. 123446790, mailed Feb. 17, 2025 (13 pages).

* cited by examiner

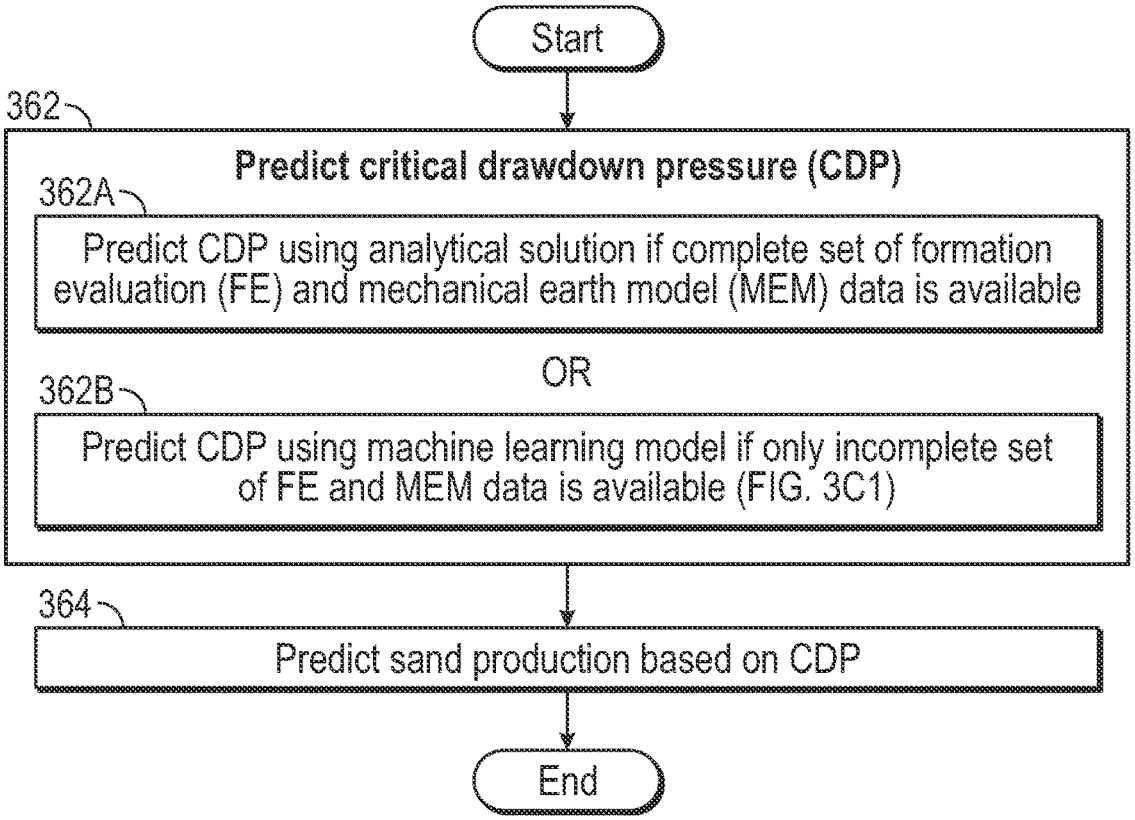
FIG. 3C
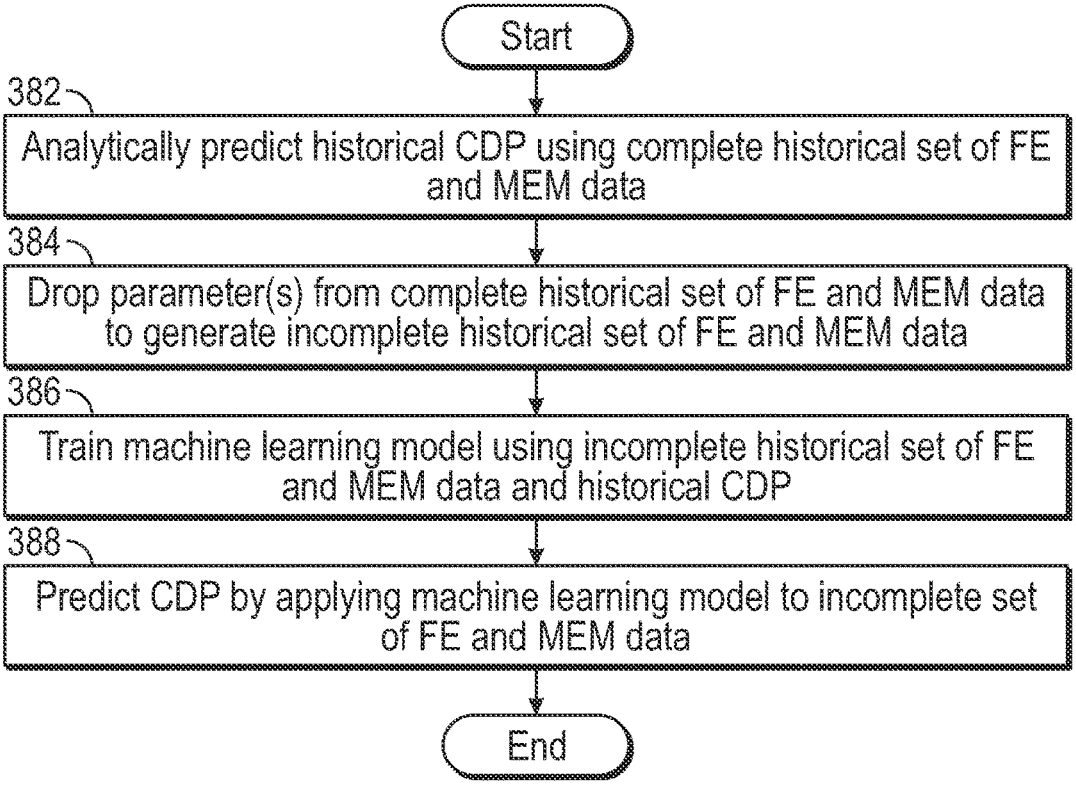
FIG. 3C1

Nomenclature $t_0$: Time step zero t + 1: Next time step t: Current time step $t_{in}$: Time increment $R_t$: Production rate at time t $P_t$: Wellhead pressure at time t $CS_t$: Surface choke size at time t $R_{sm,t}$: Smoothed production rate at time t $P_{sm,t}$: Smoothed wellhead production rate at time t $dR/dt_{sm,t}$: Production rate derivative at time t $dP/dt_{sm,t}$: Wellhead pressure derivative at time t $TH_R$: Threshold production rate derivative $TH_P$: Threshold wellhead pressure derivative $\Delta R$: Production rate drop $\Delta P$: Wellhead pressure drop $\Delta t$: Time difference between two time steps CD $DP_t$: Critical drawdown pressure at time t $DDP_t$: Current drawdown pressure at time t

FIG. 4 (Continued)

METHOD AND SYSTEM FOR DETECTING AND PREDICTING SANDING AND SAND SCREEN DEFORMATION

BACKGROUND

Sanding and sand screen deformation are widespread and costly issues in well environments used for the extraction of hydrocarbons from a hydrocarbon reservoir. When extracting fluids (e.g., oil, gas, water) from the hydrocarbon reservoir, the resulting well stream may also include solids such as sand and/or other particulate matter. A sand screen may be used to prevent these solids from entering the wellbore connecting to the hydrocarbon reservoir. The performance of the sand screen may deteriorate as the sand screen gets increasingly plugged by sand, i.e., when sanding occurs. The sand screen may also be prone to failure due to excessive pressure along with time dependent wear and tear, which may cause sand screen deformation. Sanding and sand screen deformation may affect the production profile of the well which could result in a costly and time-consuming operations to remedy the situation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method comprising: obtaining a current measurement of a production rate of a well system; obtaining a current measurement of a wellhead pressure of the well system; computing a current smoothed production rate from the current production rate; computing a current smoothed wellhead pressure from the current wellhead pressure; forward-predicting, for a time increment, using a machine learning model operating on the current smoothed production rate, the current smoothed wellhead pressure, and the current surface choke size, a future smoothed production rate and a future smoothed wellhead pressure; computing a change of the future vs the current smoothed production rate; computing a change of the future vs the current smoothed wellhead pressure; performing a first test comprising: comparing the change of the future vs the current smoothed production rate against a first pre-specified threshold production rate derivative, comparing the change of the future vs the current smoothed wellhead pressure against a first pre-specified threshold wellhead pressure derivative; and based on an outcome of the first test, determining whether a potential future occurrence of sanding is detected.

In general, in one aspect, embodiments relate to a system comprising: a flow rate sensor and a pressure sensor disposed at an upper end of a wellbore of a well system; and a well monitor configured to: obtain a current measurement of a production rate of the well system; obtain a current measurement of a wellhead pressure of the well system; compute a current smoothed production rate from the current production rate; compute a current smoothed wellhead pressure from the current wellhead pressure; forward-predicting, for a time increment, using a machine learning model operating on the current smoothed production rate, the current smoothed wellhead pressure, and the current surface choke size, a future smoothed production rate and a future smoothed wellhead pressure; compute a change of the future vs the current smoothed production rate; compute a change of the future vs the current smoothed wellhead pressure; perform a test comprising: comparing the change of the future vs the current smoothed production rate against a pre-specified threshold production rate derivative, comparing the change of the future vs the current smoothed wellhead pressure against a pre-specified threshold wellhead pressure derivative; and based on an outcome of the test, determine whether a potential future occurrence of sanding is detected.

In general, in one aspect, embodiments relate to a non-transitory machine-readable medium comprising a plurality of machine-readable instructions executed by one or more processors, the plurality of machine-readable instructions causing the one or more processors to perform operations comprising: obtaining a current measurement of a production rate of a well system; obtaining a current measurement of a wellhead pressure of the well system; computing a current smoothed production rate from the current production rate; computing a current smoothed wellhead pressure from the current wellhead pressure; forward-predicting, for a time increment, using a machine learning model operating on the current smoothed production rate, the current smoothed wellhead pressure, and the current surface choke size, a future smoothed production rate and a future smoothed wellhead pressure; computing a change of the future vs the current smoothed production rate; computing a change of the future vs the current smoothed wellhead pressure; performing a test comprising: comparing the change of the future vs the current smoothed production rate against a pre-specified threshold production rate derivative, comparing the change of the future vs the current smoothed wellhead pressure against a pre-specified threshold wellhead pressure derivative; and based on an outcome of the test, determining whether a potential future occurrence of sanding is detected.

In light of the structure and functions described above, embodiments of the invention may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

FIGS. 2, 3A, 3B, 3C, and 3C1 show flowcharts for methods in accordance with one or more embodiments.

DETAILED DESCRIPTION

Figure 1:
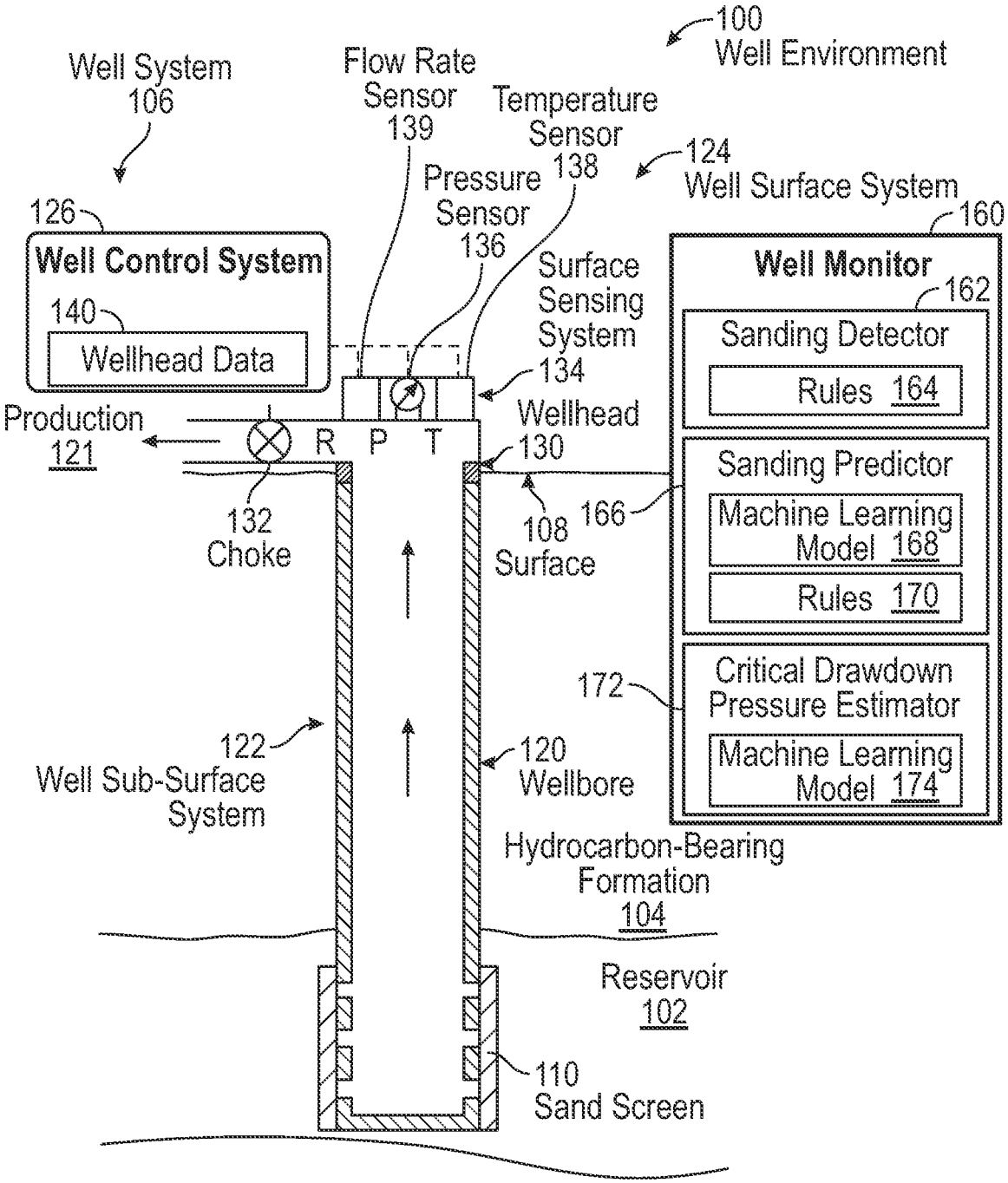
FIG. 1 shows a system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for detecting and predicting sanding and sand screen deformation. Sanding and sand screen deformation are widespread and costly issues in well environments used for the extraction of hydrocarbons from a hydrocarbon reservoir. When extracting fluids (e.g., oil, gas, water) from the hydrocarbon reservoir, the resulting well stream may also include solids such as sand and/or other particulate matter.

A sand screen may be used to prevent these solids from entering the wellbore connecting to the hydrocarbon reservoir. A detailed description of a well environment, including the hydrocarbon reservoir, the wellbore, the sand screen, and various other components is provided below in reference to FIG. 1.

The performance of the sand screen may deteriorate as the sand screen gets increasingly plugged by sand, i.e., when sanding occurs. The sanding may limit hydrocarbon production parameters such as the production rate. The sand screen may also be prone to failure due to excessive pressure along with time dependent wear and tear, which may cause sand screen deformation. The deformation of the sand screen may affect the production profile of the well which would result in a costly and time-consuming operations to remedy the situation.

Embodiments of the disclosure predict and detect sanding and sand screen deformation. Based on such predictions, an operator may take measures to avoid an actual occurrence of sanding and/or sand screen deformation, which could jeopardize the well and flow network integrity. Being able to predict sanding and/or sand screen deformation as early as possible may be highly beneficial, as it may enable a production engineer to proactively mitigate sand production and identify screen deformation issues in the field in a timely manner.

Costly and time-consuming mitigation measures including a diagnosis (e.g., using downhole diagnostic tools) followed by attempts to collect a sand sample to verify the nature of the sand fill, followed by attempts to address the sanding to restore lost productivity may, thus, be unnecessary.

Embodiments of the disclosure use machine learning models to predict a potential future occurrence of sanding by analyzing production data and identifying characteristic patterns of declining production rates (i.e., the flow rate of oil, water, and/or gas during production) and pressures that may be indicative of a future occurrence of sanding and/or sand screen deformation. The machine learning models may operate on a large volume of production data along with the geomechanics aspects of targeted formation in order to predict and/or detect sanding, sand screen deformation, and/or a critical drawdown pressure (i.e., the maximum difference between reservoir pressure and bottom-hole flowing pressure that the formation can withstand before sanding occurs).

Turning to FIG. 1, FIG. 1 shows a schematic diagram in accordance with one or more embodiments. FIG. 1 illustrates a well environment (100) that includes a hydrocarbon reservoir ("reservoir") (102) located in a subsurface hydrocarbon-bearing formation (104) and a well system (106). The hydrocarbon-bearing formation (104) may include a porous or fractured rock formation that resides underground, beneath the earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock having varying characteristics, such as varying degrees of permeability, porosity, and resistivity. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), and a well control system (126). The control system (126) may control various operations of the well system (106), such as well production operations, well completion operations, well maintenance operations, and reservoir monitoring, assessment and development operations. In some embodiments, the control system (126) includes a computer system that is the same as or similar to that of computer system (602) described below in FIG. 6 and the accompanying description.

The wellbore (120) may include a bored hole that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "downhole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) into the hydrocarbon-bearing formation (104) or the reservoir (102) during monitoring operations (e.g., during in situ logging operations).

In some embodiments, during operation of the well system (106), the control system (126) collects and records wellhead data (140) for the well system (106) and other data regarding downhole equipment and downhole sensors. The wellhead data (140) may include, for example, a record of measurements of wellhead pressure (P) (e.g., including flowing wellhead pressure (FWHP)), wellhead temperature (T) (e.g., including flowing wellhead temperature), wellhead production rate (R) over some or all of the life of the well (106), and/or water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well to assess a relatively current state of the well system (106), and make real-time decisions regarding development of the well system (106) and the reservoir (102), such as on-demand adjustments in regulation of production flow from the well.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more chokes (132) that are operable to control the flow of production (121). For example, a choke (132) may be fully opened to enable unrestricted flow of production (121) from the wellbore (120), the choke (132) may be partially opened to partially restrict (or "throttle") the flow of production (121) from the wellbore (120), and choke (132) may be fully closed to fully restrict (or "block") the flow of production (121) from the wellbore (120), and through the well surface system (124). Depending on the setting of the choke (132), different backpressures may be generated on the well subsurface system (122). An increased backpressure may reduce the pressure drop from reservoir (102) to wellbore (120), thus reducing the flow of production (121). A lower flow rate may reduce the risk of sand or other particulate matter being drawn into the sand screen (110) (described below), whereas a higher flow rate may increase the risk of sand or other particulate matter being drawn into the sand screen (110). Accordingly, the choke (132) may be used to indirectly control and limit the tendency to produce sand through adjustment of the flow of production (121), thus keeping the pressure drop from reservoir (102) to wellbore (120) below the critical drawdown pressure.

Keeping with FIG. 1, in some embodiments, the well surface system (124) includes a surface sensing system (134). The surface sensing system (134) may include sensor devices for sensing characteristics of substances, including production (121), passing through or otherwise located in the well surface system (124). The characteristics may include, for example, pressure, temperature and flow rate of production (121) flowing through the wellhead (130), or other conduits of the well surface system (124), after exiting the wellbore (120).

In some embodiments, the surface sensing system (134) includes a surface pressure sensor (136) operable to sense the pressure of production (121) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (151) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" (T). In some embodiments, the surface sensing system (134) includes a flow rate sensor (139) operable to sense the flow rate of production (121) flowing through the well surface system (124), after it exits the wellbore (120). The flow rate sensor (139) may include hardware that senses a flow rate of production (121) (R) passing through the wellhead (130).

Keeping with FIG. 1, when completing a well, one or more well completion operations may be performed prior to delivering the well to the party responsible for production or injection. Well completion operations may include casing operations, cementing operations, perforating the well, gravel packing, directional drilling, hydraulic stimulation of a reservoir region, and/or installing a production tree or wellhead assembly at the wellbore (120). Likewise, well operations may include open-hole completions or cased-hole completions. For example, an open-hole completion may refer to a well that is drilled to the top of the hydrocarbon reservoir. Thus, the well is cased at the top of the reservoir, and left open at the bottom of a wellbore. In contrast, cased-hole completions may include running casing into a reservoir region.

Some embodiments include perforation operations. More specifically, a perforation operation may include perforating casing and cement at different locations in the wellbore (120) to enable hydrocarbons to enter a well stream from the resulting holes. For example, some perforation operations include using a perforation gun at different reservoir levels to produce holed sections through the casing, cement, and sides of the wellbore (120). Hydrocarbons may then enter the well stream through these holed sections. In some embodiments, perforation operations are performed using discharging jets or shaped explosive charges to penetrate the casing around the wellbore (120).

In one well completion example, the sides of the wellbore (120) may require support, and thus casing may be inserted into the wellbore (120) to provide such support. After a well has been drilled, casing may ensure that the wellbore (120) does not close in upon itself, while also protecting the well stream from outside incumbents, like water or sand. Likewise, if the formation is firm, casing may include a solid string of steel pipe that is run on the well and will remain that way during the life of the well.

In some embodiments, the casing includes a sand screen (110) providing a filtration system that may be installed in the wellbore (120) in order to prevent sand and other debris from entering the wellbore (120). Various types of sand screens (110) may be used, without departing from the disclosure. For example, slotted liners, wire wrap screens and/or mesh screens may be used. The selection of a particular type of sand screen may be based on various considerations, including but not limited to filter medium size to retain solids while allowing the fluid to be produced with minimal resistance, expected flow volume, and/or operating environment including operational load conditions.

In another well completion, a gravel packing operation may further be performed using a gravel-packing slurry of appropriately sized pieces of coarse sand or gravel. As such, the gravel-packing slurry may be pumped into the wellbore (120) between a casing's slotted liner and the sides of the wellbore (120). The sand screen (110) and the gravel pack may filter sand and other debris that might have otherwise entered the well stream with hydrocarbons.

In another well operation example, a space between the casing and the untreated sides of the wellbore (120) may be cemented to hold a casing in place. This well operation may include pumping cement slurry into the wellbore (120) to displace existing drilling fluid and fill in this space between the casing and the untreated sides of the wellbore (120). Cement slurry may include a mixture of various additives and cement. After the cement slurry is left to harden, cement may seal the wellbore (120) from non-hydrocarbons that attempt to enter the well stream. In some embodiments, the cement slurry is forced through a lower end of the casing and into an annulus between the casing and a wall of the wellbore (120). More specifically, a cementing plug may be used for pushing the cement slurry from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

In another well completion, a wellhead assembly may be installed on the wellhead of the wellbore (120). A wellhead assembly may be a production tree (also called a Christmas tree) that includes valves, gauges, and other components to provide surface control of subsurface conditions of a well.

In some embodiments, a wellbore (120) includes one or more casing centralizers. For example, a casing centralizer may be a mechanical device that secures casing at various locations in a wellbore to prevent casing from contacting the walls of the wellbore. Thus, casing centralization may produce a continuous annular clearance around casing such that cement may be used to completely seal the casing to walls of the wellbore. Without casing centralization, a cementing operation may experience mud channeling and poor zonal isolation. Examples of casing centralizers may include bow-spring centralizers, rigid centralizers, semi-rigid centralizers, and mold-on centralizers. In particular, bow springs may be slightly larger than a particular wellbore in order to provide complete centralization in vertical or slightly deviated wells. On the other hand, rigid centralizers may be manufactured from solid steel bar or cast iron with a fixed blade height in order to fit a specific casing or hole size. Rigid centralizers may perform well even in deviated wellbores regardless of any particular side forces. Semi-rigid centralizers may be made of double crested bows and operate as a hybrid centralizer that includes features of both bow-spring and rigid centralizers. The spring characteristic of the bow-spring centralizers may allow the semi-rigid centralizers to compress in order to be disposed in tight spots in a wellbore. Mold-on centralizers may have blades made of carbon fiber ceramic material that can be applied directly to a casing surface.

In some embodiments, well intervention operations may also be performed at a well site. For example, well intervention operations may include various operations carried out by one or more service entities for an oil or gas well during its productive life (e.g., fracking operations, CT, flow back, separator, pumping, wellhead and production tree maintenance, slickline, braded line, coiled tubing, snubbing, workover, subsea well intervention, etc.). For example, well intervention activities may be similar to well completion operations, well delivery operations, and/or drilling operations in order to modify the state of a well or well geometry. In some embodiments, well intervention operations are used to provide well diagnostics, and/or manage the production of the well. With respect to service entities, a service entity may be a company or other actor that performs one or more types of oil field services, such as well operations, at a well site. For example, one or more service entities may be responsible for performing a cementing operation in the wellbore (120) prior to delivering the well to a producing entity.

Turning to the well monitor (160), a well monitor (160) may include hardware and/or software with functionality for storing and analyzing well logs, production data, sensor data (e.g., from a wellhead, downhole sensor devices, or flow control devices), and/or other types of data to generate and/or update one or more geological models of one or more reservoir regions. Geological models may include geochemical or geomechanical models that describe structural relationships within a particular geological region. Likewise, a well monitor (160) may also determine changes in reservoir pressure and other reservoir properties for a geological region of interest, e.g., in order to evaluate the health of a particular reservoir during the lifetime of one or more producing wells.

In one or more embodiments, the well monitor (160) performs operations for methods described in reference to the flowcharts of FIGS. 2, 3A, 3B, and 3C. Software instructions in the form of computer readable program code to perform the operations in accordance with embodiments may be stored, in whole or in part, temporarily or permanently, on a non-transitory computer readable medium. More specifically, the well monitor (160) includes a sanding detector (162), a sanding predictor (166), and a critical drawdown pressure estimator (172).

The sanding detector (162), in one or more embodiments, is configured to detect a potential occurrence of sanding in a well. The detection may be performed using rules (164), e.g., conditional statements, applied to current and past production data to decide whether sanding is present. The details are provided below in reference to the flowchart of FIG. 3A.

The sanding predictor (166), in one or more embodiments, is configured to predict of a potential future occurrence of sanding in a well. The detection may be performed using a machine learning model (168) and rules (170). In one or more embodiments, the machine learning model (168) makes a forward prediction of future production data based on current production data. Subsequently, the rules (170) are applied to the current production data and future forward-predicted production data to decide whether sanding is imminent. The details are provided below in reference to the flowchart of FIG. 3B.

The critical drawdown pressure estimator (172), in one or more embodiments, is configured to estimate the critical drawdown pressure associated with the well. Comparison of an actual drawdown pressure to the critical drawdown pressure, may help assess the likeliness of sanding. The estimation may be performed by a machine learning model (174) operating on production data along with the geomechanics aspects of targeted formation. The details are provided below in reference to the flowchart of FIG. 3C.

The machine learning models (168, 174) may be based on any type of machine learning technique. For example, perceptrons, convolutional neural networks, deep neural networks, recurrent neural networks, support vector machines, decision trees, inductive learning models, deductive learning models, supervised learning models, unsupervised learning models, reinforcement learning models, etc. may be used. In some embodiments, two or more different types of machine-learning models are integrated into a single machine-learning architecture, e.g., a machine-learning model may include support vector machines and neural networks.

In some embodiments, various types of machine learning algorithms, e.g., backpropagation algorithms, may be used to train the machine learning models. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function"). The error function may be based on various criteria, such as mean squared error function, a similarity function, etc., where the error function may be used as a feedback mechanism for tuning weights in the machine-learning model. In some embodiments, historical data, e.g., production data recorded over time may be augmented to generate synthetic data for training a machine learning model.

With respect to neural networks, for example, a neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights for adjusting the data inputs. These network weights may amplify or reduce the value of a particular data input, thereby assigning an amount of significance to various data inputs for a task being modeled. Through machine learning, a neural network may determine which data inputs should receive greater priority in determining one or more specified outputs of the neural network. Likewise, these weighted data inputs may be summed such that this sum is communicated through a neuron's activation function to other hidden layers within the neural network. As such, the activation function may determine whether and to what extent an output of a neuron progresses to other neurons where the output may be weighted again for use as an input to the next hidden layer.

Turning to recurrent neural networks, a recurrent neural network (RNN) may perform a particular task repeatedly for multiple data elements in an input sequence (e.g., a sequence of maintenance data or inspection data), with the output of the recurrent neural network being dependent on past computations (e.g., failure to perform maintenance or address an unsafe condition may produce one or more hazard incidents). As such, a recurrent neural network may operate with a memory or hidden cell state, which provides information for use by the current cell computation with respect to the current data input. For example, a recurrent neural network may resemble a chain-like structure of RNN cells, where different types of recurrent neural networks may have different types of repeating RNN cells. Likewise, the input sequence may be time-series data, where hidden cell states may have different values at different time steps during a prediction or training operation. For example, where a deep neural network may use different parameters at each hidden layer, a recurrent neural network may have common parameters in an RNN cell, which may be performed across multiple time steps. To train a recurrent neural network, a supervised learning algorithm such as a backpropagation algorithm may also be used. In some embodiments, the backpropagation algorithm is a backpropagation through time (BPTT) algorithm. Likewise, a BPTT algorithm may determine gradients to update various hidden layers and neurons within a recurrent neural network in a similar manner as used to train various deep neural networks. In some embodiments, a recurrent neural network is trained using a reinforcement learning algorithm such as a deep reinforcement learning algorithm. For more information on reinforcement learning algorithms, see the discussion below.

Embodiments are contemplated with different types of RNNs. For example, classic RNNs, long short-term memory (LSTM) networks, a gated recurrent unit (GRU), a stacked LSTM that includes multiple hidden LSTM layers (i.e., each LSTM layer includes multiple RNN cells), recurrent neural networks with attention (i.e., the machine-learning model may focus attention on specific elements in an input sequence), bidirectional recurrent neural networks (e.g., a machine-learning model that may be trained in both time directions simultaneously, with separate hidden layers, such as forward layers and backward layers), as well as multidimensional LSTM networks, graph recurrent neural networks, grid recurrent neural networks, etc., may be used. With regard to LSTM networks, an LSTM cell may include various output lines that carry vectors of information, e.g., from the output of one LSTM cell to the input of another LSTM cell. Thus, an LSTM cell may include multiple hidden layers as well as various pointwise operation units that perform computations such as vector addition.

In some embodiments, one or more ensemble learning methods may be used in connection to the machine-learning models. For example, an ensemble learning method may use multiple types of machine-learning models to obtain better predictive performance than available with a single machine-learning model. In some embodiments, for example, an ensemble architecture may combine multiple base models to produce a single machine-learning model. One example of an ensemble learning method is a BAGGing model (i.e., BAGGing refers to a model that performs Bootstrapping and Aggregation operations) that combines predictions from multiple neural networks to add a bias that reduces variance of a single trained neural network model. Another ensemble learning method includes a stacking method, which may involve fitting many different model types on the same data and using another machine-learning model to combine various predictions.

A description of the actual use of the machine learning models (168, 174) is provided below in reference to the flowcharts of FIGS. 2, 3B, and 3C.

While the well monitor (160) is shown at a well site, in some embodiments, the well monitor (160) or other components in FIG. 1 may be remote from a well site. In some embodiments, the well monitor (160) is implemented as part of a software platform for the well control system (126). The software platform may obtain data acquired by a control system as inputs, which may include multiple data types from multiple sources. The software platform may aggregate the data from these systems in real time for rapid analysis. In some embodiments, the well control system (126) and the well monitor (160), and/or a user device coupled to one of these systems may include a computer system that is similar to the computer system (602) described below with regard to FIG. 6 and the accompanying description.

While FIG. 1 shows various configurations of hardware components and/or software components, other configurations may be used without departing from the scope of the disclosure. For example, various components in FIG. 1 may be combined to create a single component. As another example, the functionality performed by a single component may be performed by two or more components.

Figure 2:
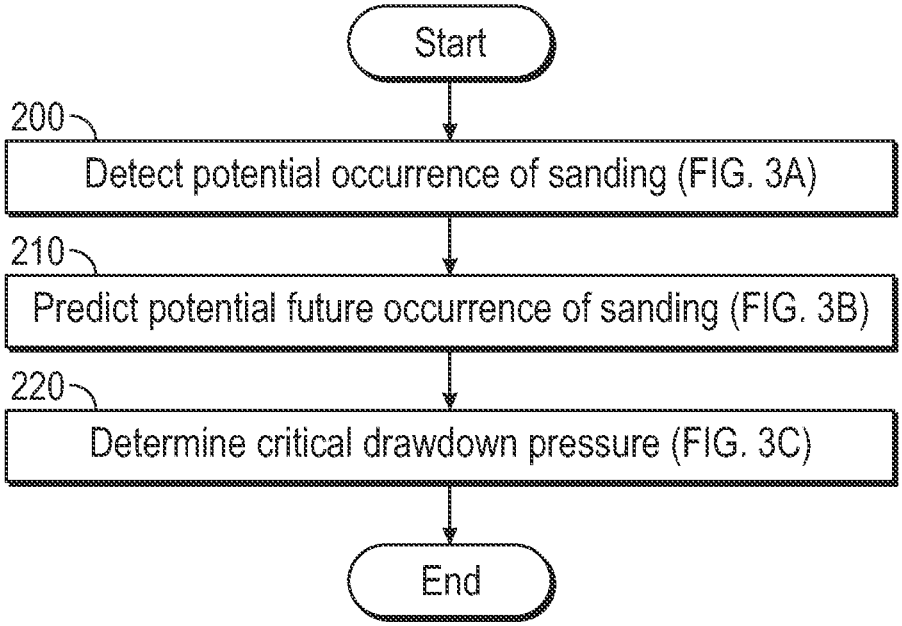

FIGS. 2, 3A, 3B, and 3C show flowcharts in accordance with one or more embodiments. FIG. 2, introduces operations performed to facilitate the detection and prediction of unexpected sand production and possible sand screen deformation within a producing oil/gas well, in accordance with one or more embodiments. The operations are described in more detail in reference to FIGS. 3A, 3B, and 3C. Further, an example of an actual implementation, providing additional details, is shown in FIG. 4.

One or more blocks in FIGS. 2, 3A, 3B, and 3C may be performed by one or more components (e.g., well monitor (160) as described in FIG. 1). While the various blocks in FIGS. 2, 3A, 3B, and 3C are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Turning to FIG. 2, a method to facilitate the detection and prediction of unexpected sand production and possible sand screen deformation within a producing oil/gas well, in accordance with one or more embodiments, is shown.

In Block 200, a detection of a potential occurrence of sanding is performed for a well system. The detection may be for a current rather than a future occurrence of sanding. The details are provided below in reference to the flowchart of FIG. 3A.

In Block 210, a detection of a future occurrence of sanding is performed for the well system. The detection may be for an upcoming rather than a current occurrence of sanding. The details are provided below in reference to the flowchart of FIG. 3B.

In Block 220, a critical drawdown pressure is determined, beyond which sanding may occur, for the well system. The details are provided below in reference to the flowchart of FIG. 3C.

One or more of the operations of Blocks 200, 210, and 220 may be performed either simultaneously or sequentially.

Figure 3A:
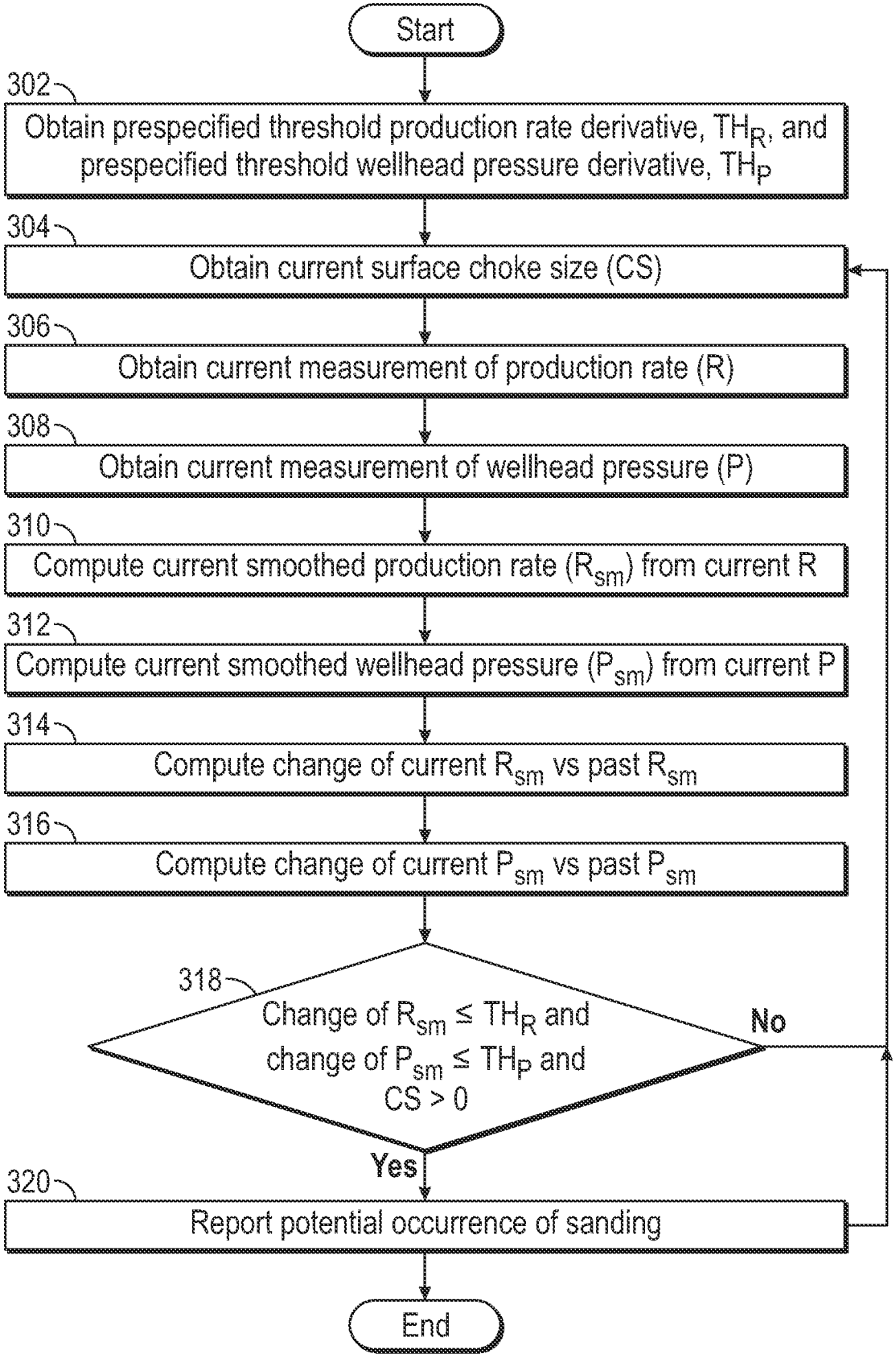
Figure 4:
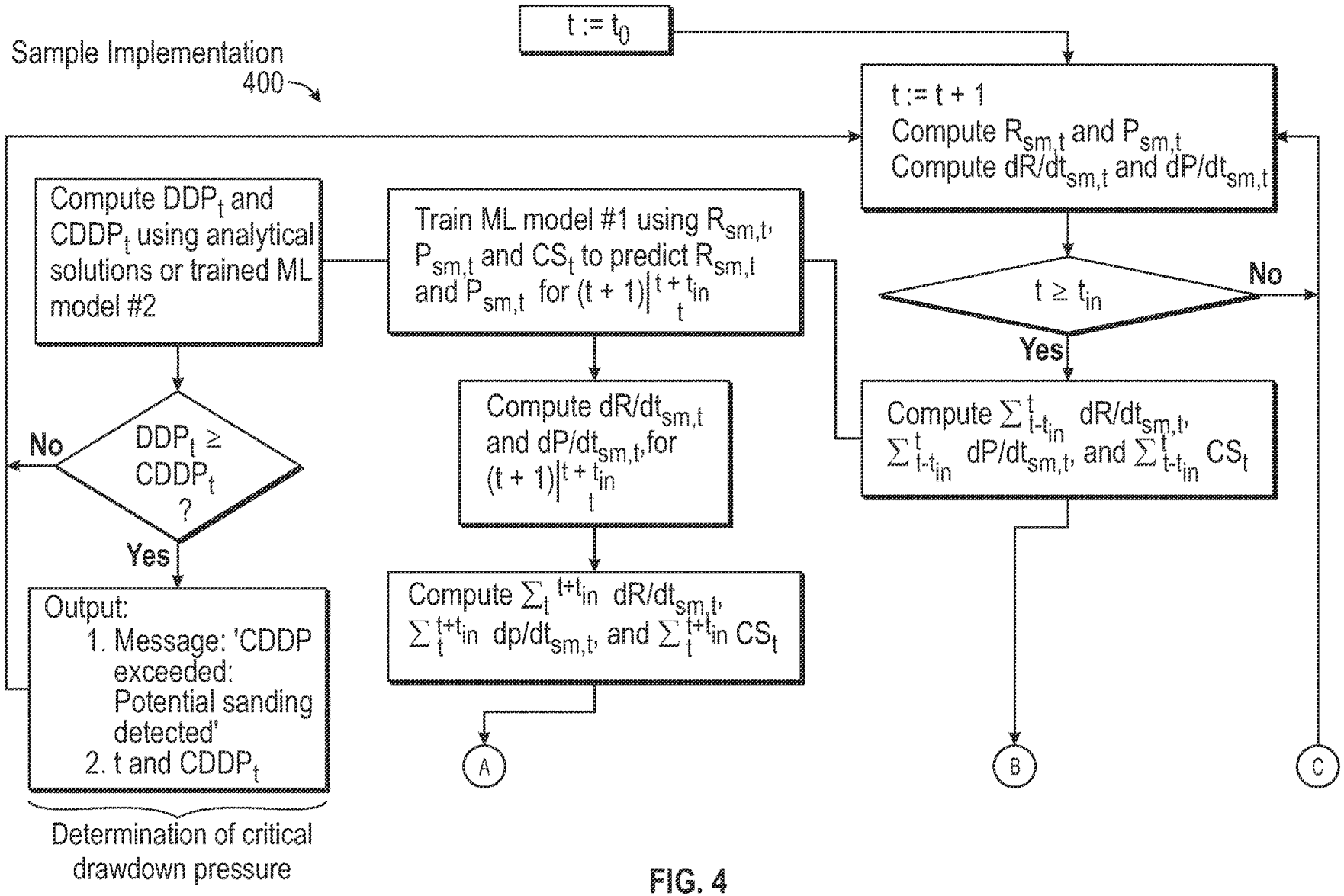
FIG. 4 shows a sample implementation in accordance with one or more embodiments.
Figure 4:
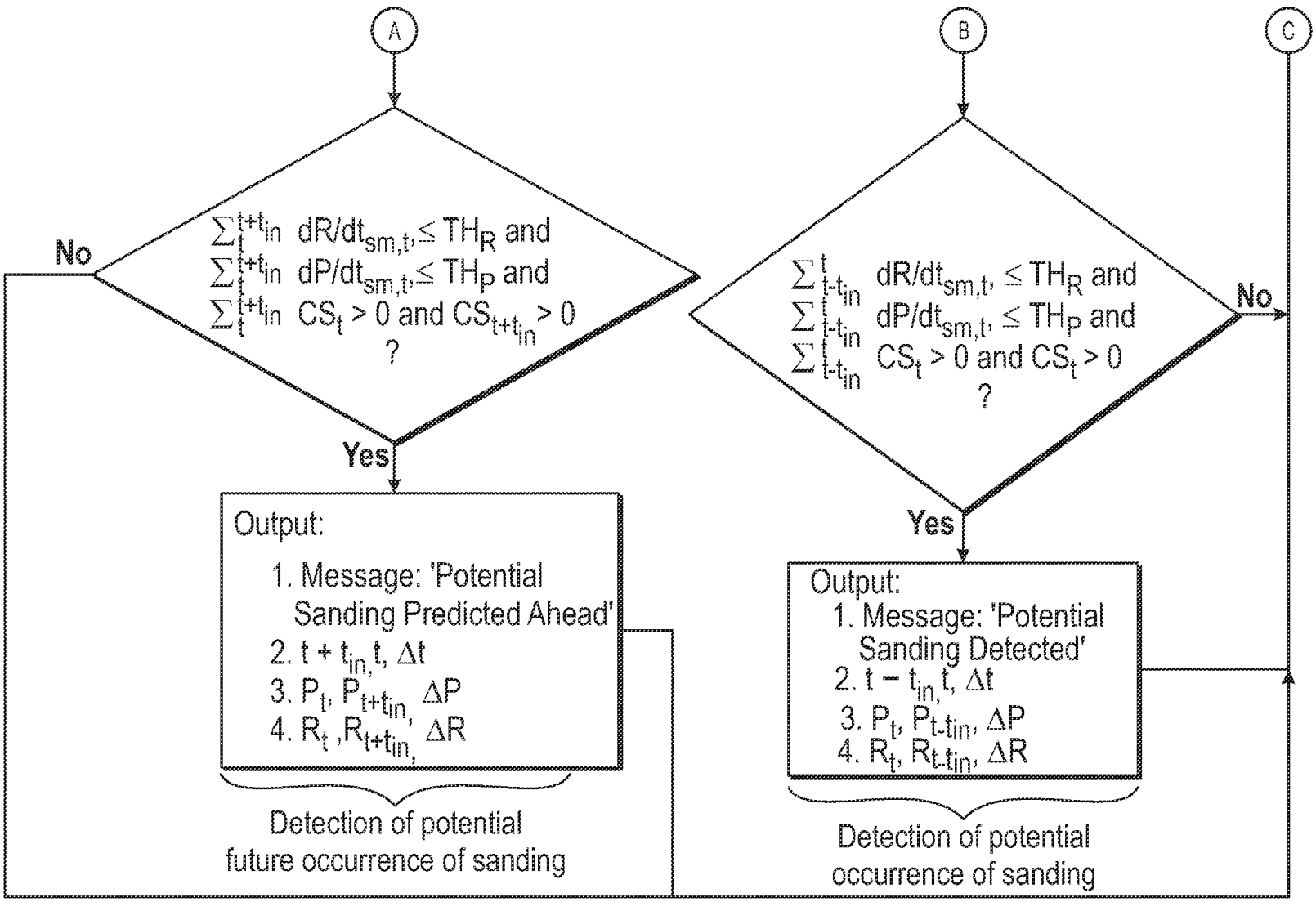

Turning to FIG. 3A, a method for detecting a potential occurrence of sanding, in accordance with one or more embodiments, is shown.

In Block 302, prespecified thresholds are obtained. The prespecified threshold may be obtained from a memory or may be entered by an operator.

A threshold production rate derivative, $TH_R$, is obtained. The production rate derivative may be a derivative of the production rate, R, as previously described in reference to FIG. 1. The derivative of R may characterize a change of the production rate during a time increment, as further discussed below. $TH_R$, in one or more embodiments, establishes a threshold for a change in R during the time increment based on which a decision may be made regarding an occurrence of sanding, as discussed in detail below. Accordingly, the value of $TH_R$ may be selected such that it may serve as a meaningful indicator for the occurrence of sanding. A discussion of the selection of $TH_R$ is provided below in reference to FIG. 5.

A threshold wellhead pressure derivative, $TH_P$, is obtained. The wellhead pressure derivative may be a derivative of the wellhead pressure, P, as previously described in reference to FIG. 1. The derivative of P may characterize a change of the wellhead pressure during the time increment, as further discussed below. $TH_P$, in one or more embodiments, establishes a threshold for a change in P during the time increment based on which a decision may be made regarding an occurrence of sanding, as discussed in detail below. Accordingly, the value of $TH_P$ may be selected such that it may serve as a meaningful indicator for the occurrence of sanding. A discussion of the selection of $TH_P$ is provided below in reference to FIG. 5.

In Block 304, a current surface choke size (CS) is obtained. CS may be obtained for the choke described in reference to FIG. 1. A value for CS may be entered by an operator, based on the current setting of a manually operated choke. For a choke that is actuated (e.g., by an electric or hydraulic actuator), CS may be the commanded value used to set the choke. CS may be specified as a percentage, in a range from 0% (fully restricted) to 100% (unrestricted) of the choke being used. Alternatively, absolute values may be used.

In Block 306, a current measurement of the production rate, R, is obtained. R may be obtained from a sensor of a surface sensing system, as described in reference to FIG. 1. The surface sensing system may perform measurements at a certain rate, e.g., once per second, once per minute, etc. In Block 306, the most recently obtained measurement of R may be used as the current measurement of R.

In Block 308, a current measurement of the wellhead pressure, P, is obtained. P may be obtained from a sensor of a surface sensing system, as described in reference to FIG. 1. In Block 308, the most recently obtained measurement of P may be used as the current measurement of P.

In Block 310, a current smoothed production rate, $R_{sm}$, is computed from R. Any type of smoothing, e.g., a moving average of R over time or a lowpass filtering in the frequency domain after performing a Discrete Fourier Transform, may be used to determine $R_{sm}$.

In Block 312, a current smoothed wellhead pressure, $P_{sm}$, is computed from P. Any type of smoothing, e.g., a moving average of P over time or a lowpass filtering in the frequency domain after performing a Discrete Fourier Transform, may be used to determine $P_{sm}$.

In Block 314, a change of the current $R_{sm}$ vs a past $R_{sm}$ is computed. The past $R_{sm}$ may have been obtained from an earlier execution of Block 310. A specified time increment, $t_{in}$, may separate the current $R_{sm}$ from the past $R_{sm}$ in time. $t_{in}$ may be set to, for example, seven days. The time increment may be user-definable, and the user may set any value. Additional details regarding the computation of the change of the current $R_{sm}$ vs the past $R_{sm}$ are provided below, in reference to FIG. 4.

In Block 316, a change of the current $P_{sm}$ vs a past $P_{sm}$ is computed. The past $P_{sm}$ may have been obtained from an earlier execution of Block 308. The specified time increment, $t_{in}$, may separate the current $P_{sm}$ from the past $P_{sm}$ in time. Additional details regarding the computation of the change of the current $P_{sm}$ vs the past $P_{sm}$ are provided below, in reference to FIG. 4.

In Block 318, a test is performed to determine whether sanding is potentially occurring. The test, in one or more embodiments, involves:

(i) a comparison of the change of the current $R_{sm}$ vs the past $R_{sm}$ against the pre-specified threshold, $TH_R$, and (ii) a comparison of the change of the current $P_{sm}$ vs the past $P_{sm}$ against the pre-specified threshold, $TH_P$.

If the test indicates that both changes are drops exceeding the corresponding thresholds, it may be concluded that sanding is potentially occurring. The rationale for this conclusion is discussed below, in reference to FIG. 5. Alternatively, if the test indicates that the changes are not both drops that exceed the corresponding thresholds, it may be concluded that no sanding is currently occurring.

The test of Block 318 may further involve a verification of the surface choke size CS during the time increment. Specifically, an additional condition may require CS to be above zero at any time during the time increment under consideration, to conclude that sanding is potentially occurring.

In Block 320, the potential occurrence of sanding is reported. The reporting may include additional information such as timing, production rate and wellhead pressure information, as further discussed in reference to FIG. 4.

After completion of the operations as described, the execution of the method may continue with Block 304 to perform the described operations for another time increment. Accordingly, the operations of the flowchart of FIG. 3A may be performed in a loop, over time.

Figure 3B:
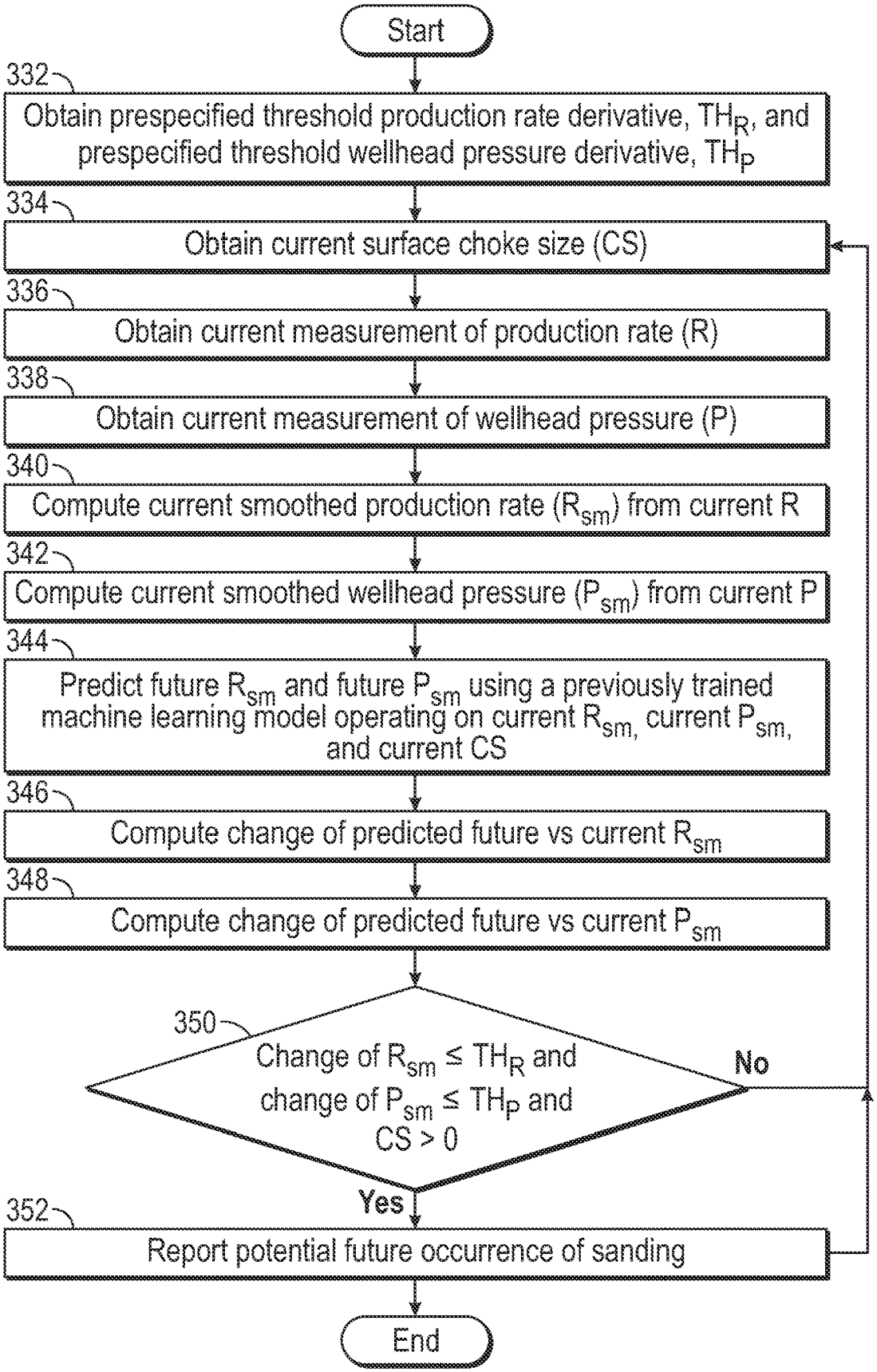

Turning to FIG. 3B, a method for predicting a potential future occurrence of sanding, in accordance with one or more embodiments, is shown.

In Block 332, prespecified thresholds are obtained. The prespecified thresholds may correspond to the prespecified thresholds as previously described in reference to FIG. 3A. The same or different values may be used for the prespecified thresholds. The prespecified thresholds obtained in Block 332 may be used to predict a potential future occurrence of sanding. In contrast, the prespecified thresholds obtained in Block 302 of FIG. 3A may be used to determine whether sanding is currently occurring.

In Block 334, a current surface choke size (CS) is obtained. The CS obtained in Block 334 may correspond to the CS in Block 304 of FIG. 3A.

In Block 336, a current measurement of the production rate, R, is obtained.

The R obtained in Block 336 may correspond to the R obtained in Block 306 of FIG. 3A.

In Block 338, a current measurement of the wellhead pressure, P, is obtained.

The P obtained in Block 338 may correspond to the R obtained in Block 308 of FIG. 3A.

In Block 340, a current smoothed production rate, $R_{sm}$, is computed from R. The $R_{sm}$ obtained in Block 340 may correspond to the $R_{sm}$ obtained in Block 310 of FIG. 3A.

In Block 342, a current smoothed wellhead pressure, $P_{sm}$, is computed from P. The $P_{sm}$ obtained in Block 342 may correspond to the $P_{sm}$ obtained in Block 312 of FIG. 3A.

In one or more embodiments, Blocks 332-342 correspond to Blocks 302-312 of FIG. 3A. Accordingly, the operations of these blocks may be performed only once, when both methods of FIGS. 3A and 3B are executed.

In Block 344, a forward prediction is performed to predict a future $R_{sm}$ and a future $P_{sm}$ based on the current $R_{sm}$, the current $P_{sm}$, the current CS. The prediction may be made for a specified time increment, $t_{in}$, so that the future $R_{sm}$ and $P_{sm}$ are separated by $t_{in}$ from the current $R_{sm}$ and $P_{sm}$. The specified time increment, $t_{in}$, may be, for example, seven days. In one or more embodiments, the forward prediction is performed by a machine learning model. The machine learning model may be, for example, a Multilayer Perceptron (MLP) model, Convolutional Neural Network (CNN) model, Recurrent Neural Network (RNN) model, CNN-RNN hybrid model, or any other ML model. In one or more embodiments, the current $R_{sm}$, the current $P_{sm}$, and the current CS are combined in a feature vector as an input to the machine learning model (e.g., machine learning model (168) of FIG. 1). The machine learning model, after having been trained to perform a forward prediction, provides a prediction of a future $R_{sm}$, and a future $P_{sm}$ as the output. Although future and current $R_{sm}$ and $P_{sm}$ may be separated by the time increment $t_{in}$, the actual prediction by the machine learning model may be iteratively performed in smaller time steps. A more detailed description is provided below, in reference to FIG. 4. In order to enable the machine learning model to predict continuous variables such as $R_{sm}$, and $P_{sm}$, the machine learning model may be equipped with linear activation functions instead of activation functions commonly used for classifier-type neural networks (e.g., softmax functions).

Figure 5:
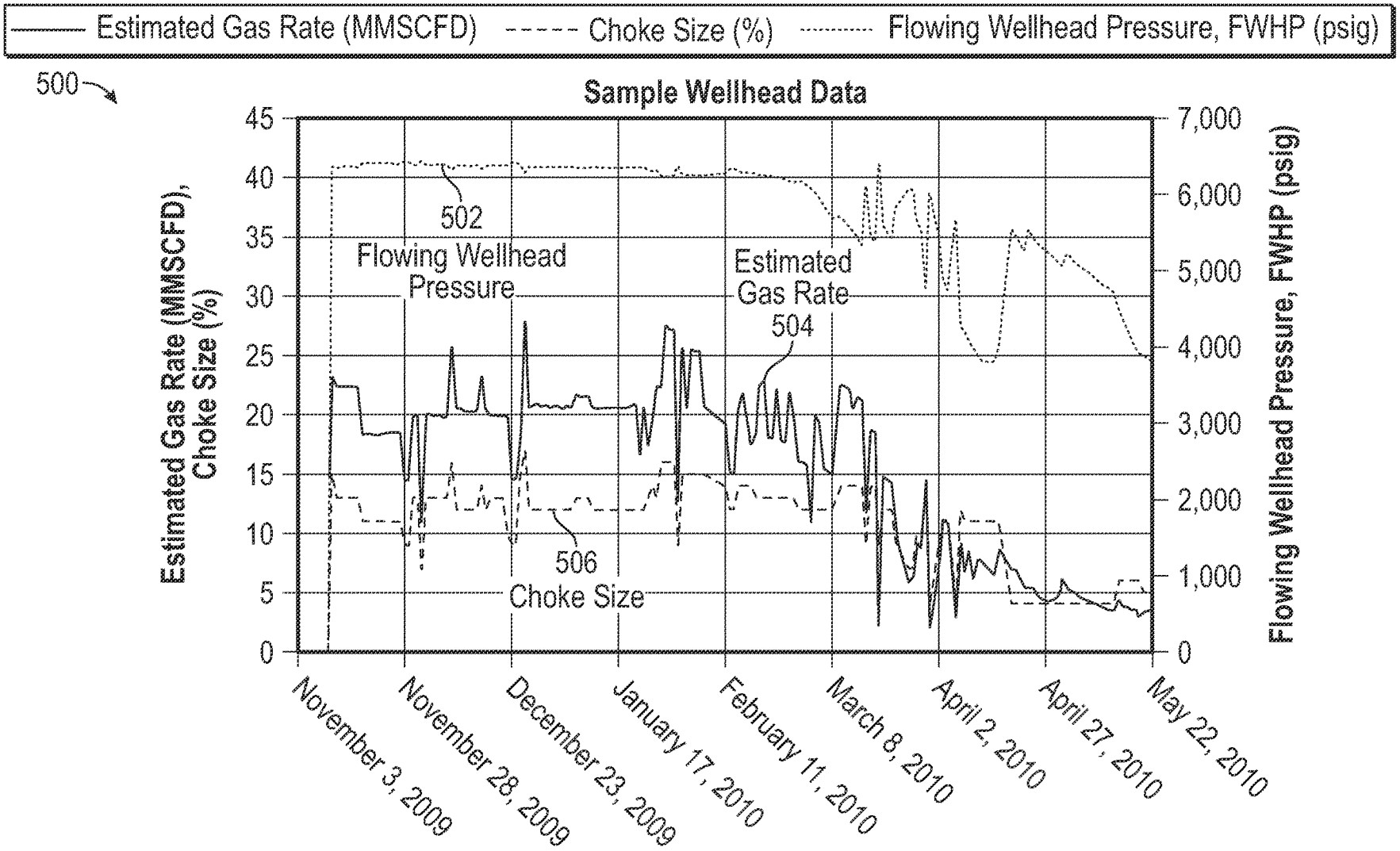
FIG. 5 shows sample wellhead data in accordance with one or more embodiments.

In one or more embodiments, the machine learning model has been trained, prior to the execution of Block 344. The training may have been performed using historical data for $R_{sm}$, $P_{sm}$, and CS. An example of historical data is shown in FIG. 5. The historical data may include episodes of sanding, and episodes of regular operation. A mix of episodes of sanding and episodes of regular operation may be selected for the training. Backpropagation may be used for training the machine learning model based on the selected historical data. Some of the historical data may be used for training, and some of the historical data may be used for validation.

In Block 346, a change of the predicted future $R_{sm}$ vs the current $R_{sm}$ over the time interval, $t_{in}$, is computed. Additional details regarding the computation of the change of the future $R_{sm}$ vs the current $R_{sm}$ are provided below, in reference to FIG. 4.

In Block 348, a change of the predicted future $P_{sm}$ vs the current $P_{sm}$ over the time interval, $t_{in}$, is computed. Additional details regarding the computation of the change of the future $P_{sm}$ vs the current $P_{sm}$ are provided below, in reference to FIG. 4.

In Block 350, a test is performed to determine whether sanding is potentially about to occur. The test, in one or more embodiments, involves:

(i) a comparison of the change of the future $R_{sm}$ vs the current $R_{sm}$ against the pre-specified threshold, $TH_R$, and (ii) a comparison of the change of the future $P_{sm}$ vs the current $P_{sm}$ against the pre-specified threshold, $TH_P$.

If the test indicates that both changes are drops exceeding the corresponding thresholds, it may be concluded that sanding is potentially about to occur. The rationale for this conclusion is discussed below, in reference to FIG. 5. Alternatively, if the test indicates that the changes are not both drops that exceed the corresponding thresholds, it may be concluded that no sanding will occur in the near future.

The test of Block 350 may further involve a verification of the surface choke size CS during the time increment. Specifically, an additional condition may require CS to be above zero at any time during the time increment under consideration, to conclude that sanding is potentially about to occur.

In Block 352, the potential future occurrence of sanding is reported. The reporting may include additional information such as timing, production rate and wellhead pressure information, as further discussed in reference to FIG. 4.

After completion of the operations as described, the execution of the method may continue with Block 334 to perform the described operations for another time increment. Accordingly, the operations of the flowchart of FIG. 3B may be performed in a loop, over time.

Turning to FIG. 3C, a method for determining a critical drawdown pressure, in accordance with one or more embodiments, is shown.

In Block 362, the critical drawdown pressure (CDP) is predicted. Different methods may be used to predict the CDP. For example, in Block 362A, an analytical solution may be obtained for the CDP if a complete set of formation evaluation (FE) and mechanical earth model (MEM) data is available. If the complete set of FE and MEM data is not available for calculating the CDP, alternative methods may be used to predict the CDP. For example, in Block 362B, the CDP is predicted using a machine learning model that operates on an incomplete set of FE and MEM data. Additional details are provided in FIG. 3C1.

In Block 364, sanding is predicted based on the CDP. More specifically, the actual drawdown pressure may be compared against the critical drawdown pressure. If the actual drawdown pressure exceeds the CDP, sanding is likely to occur.

Turning to FIG. 3C1, a method for predicting the CDP using a machine learning model based on an incomplete set of FE and MEM data is shown.

In Block 382, a prediction of a historical CDP is performed based on a complete historical set of FE and MEM data. The complete historical set of FE and MEM data may have been obtained at any time and may be assumed to be representative for the FE and MEM data for which the CDP is to be estimated. In one or more embodiments, the prediction for the historical CDP is obtained using the analytical solution, because the complete historical set of FE and MEM data includes data values for all parameters required for the analytical solution.

In Block 384, data values for one or more parameters are dropped from the historical set of FE and MEM data to generate an incomplete historical set of FE and MEM data. The parameters that are dropped are selected to eliminate those parameters that are missing in the set of FE and MEM data for which a prediction of the CDP is to be performed.

In Block 386, a machine learning model is trained using the combination of the incomplete historical set of FE and MEM data and the historical CDP. Any method of supervised learning may be used, with the incomplete historical set of FE and MEM data serving as the input, and the historical CDP as the output. The training may include validation and performance validation. The resulting trained machine learning model may then be used for predicting the CDP based on the set or FE and MEM data for which the prediction is to be performed.

Any type of machine learning model may be used. In one embodiment, a k-nearest neighbor method is used in a regression-type configuration for a continuous prediction of the CDP. Further, in one embodiment, a multi-resolution graph-based clustering (MRGC) is used to determine the number, k, of clusters to be used for the k-nearest neighbor method. Any other method, such as cross-validation may be used to determine the number of clusters, k.

In Block 388, the machine learning model, after training, is applied to the incomplete set of FE and MEM data to predict the CDP.

Turning to FIG. 4, a sample implementation of a method for detecting and predicting sanding, in accordance with one or more embodiments, is shown. The sample implementation (400) includes three main branches corresponding to the flowcharts of FIGS. 3A, 3B, and 3C. The implementation of a detection of a potential occurrence of sanding (right branch, in FIG. 4), corresponds to the method shown in FIG. 3A. The implementation of a detection of a potential future occurrence of sanding (center branch, in FIG. 4), corresponds to the method shown in FIG. 3B. The implementation of a determination of a critical drawdown pressure (left branch, in FIG. 4), corresponds to the method shown in FIG. 3C.

The sample implementation (400) begins at time step zero, to. As previously described in reference to the flowcharts of FIGS. 3A-3C, the operations are performed for the time increment, $t_{in}$. $t_{in}$ may be, for example, seven days, or any other time increment. However, in the sample implementation (400), the time increment, $t_{in}$, is incrementally completed by performing time steps. A time step may be based on the availability of new sensor data, (e.g., one minute, if $R_t$, $P_t$, and/or CS are acquired once per minute, or any other time interval). The sample implementation (400), thus, tests whether a time, t, of at least time increment, $t_{in}$, has elapsed. Once a time increment $t_{in}$ has been completed, the operations to determine changes in the production rate and the wellhead pressure and subsequent operations as described in reference to FIGS. 3A and 3B, may be performed. Due to the incremental data recorded during $t_{in}$, the operations are incrementally performed for the time steps, t, within the time increment, $t_{in}$, as indicated by the summing operations in the sample implementation (400).

Referring to the right branch of the sample implementation (400), when a potential occurrence of sanding is detected, various parameters are reported. In the sample implementation (400), the reported parameters include: $t-t_{in}$, i.e., the time at beginning of the time increment for which sanding was detected; t, i.e., the time at the end of the time increment for which sanding was detected; and $\Delta t$, i.e., the time difference between two time steps. The reported parameters further include $P_t$, i.e., the wellhead pressure at the end of the time increment for which sanding was detected; $P_{t-tin}$, i.e., the wellhead pressure at the beginning of the time increment for which sanding was detected; and $\Delta P$, i.e., the wellhead pressure drop. The reported parameters further include $R_t$, i.e., the production rate at the end of the time increment for which sanding was detected; $R_{t-tin}$, i.e., the production rate at the beginning of the time increment for which sanding was detected; and $\Delta R$, i.e., the production rate drop.

Referring to the center branch of the sample implementation (400), when a potential future occurrence of sanding is detected, various parameters are reported. In the sample implementation (400), the reported parameters include: $t+t_{in}$, i.e., the time at end of the time increment for which sanding was forward-predicted; t, i.e., the time at the beginning of the time increment for which sanding was forward-predicted; and $\Delta t$, i.e., the time difference between two time steps. The reported parameters further include $P_t$, i.e., the wellhead pressure at the beginning of the time increment for which sanding was forward-predicted; $P_{t+tin}$, i.e., the wellhead pressure at the end of the time increment for which sanding was forward-predicted; and $\Delta P$, i.e., the predicted wellhead pressure drop. The reported parameters further include $R_t$, i.e., the production rate at the beginning of the time increment for which sanding was forward-predicted; $R_{t+tin}$, i.e., the production rate at the end of the time increment for which sanding was forward-predicted; and $\Delta R$, i.e., the predicted production rate drop.

Referring to the left branch of the sample implementation (400), when a potential occurrence of sanding is detected based on the actual drawdown pressure reaching or exceeding the critical drawdown pressure, various parameters are reported. In the sample implementation (400), the reported parameters include the time when the potential sanding was detected, and the critical drawdown pressure.

Turning to FIG. 5 sample wellhead data (500) in accordance with one or more embodiments are shown. The sample wellhead data (500) include recordings of a flowing wellhead pressure (P) (502), an estimated gas rate (R) (504), and a choke size (CS) (506), over time. By visual inspection, the sample wellhead data (500) may be separated into a left half where P and R are relatively constant, and a right half, where P and R are dropping. In the example shown in FIG. 5, the drop in P and R were confirmed to be a result of sanding. Accordingly, an occurrence of sanding may be directly detectable based on a drop of P and R, which may thus serve as indicators for sanding. Embodiments of the disclosure, as described in reference to the flowcharts of FIGS. 3A and 3B, thus, analyze P and R to determine whether sanding is occurring or likely to occur in the near future. Specifically, based on a detection that a drop in both P and R exceeds certain thresholds ($TH_P$, $TH_R$), a prediction may be made that sanding is occurring or is about to occur. As FIG. 5 illustrates, $TH_P$ and $TH_R$ may be selected such that false positives (detection of a drop in the left half of the sample wellhead data (500) is avoided, while a detection of an actual sanding event (right half of the sample wellhead data (500)) is made. $TH_P$ and $TH_R$ may be set in a well-specific manner, or alternatively, known good thresholds may be used. Data similar to the sample wellhead data (500) may further be used to train the machine learning model to predict future P and R based on the current P, R, and CS.

Figure 6:
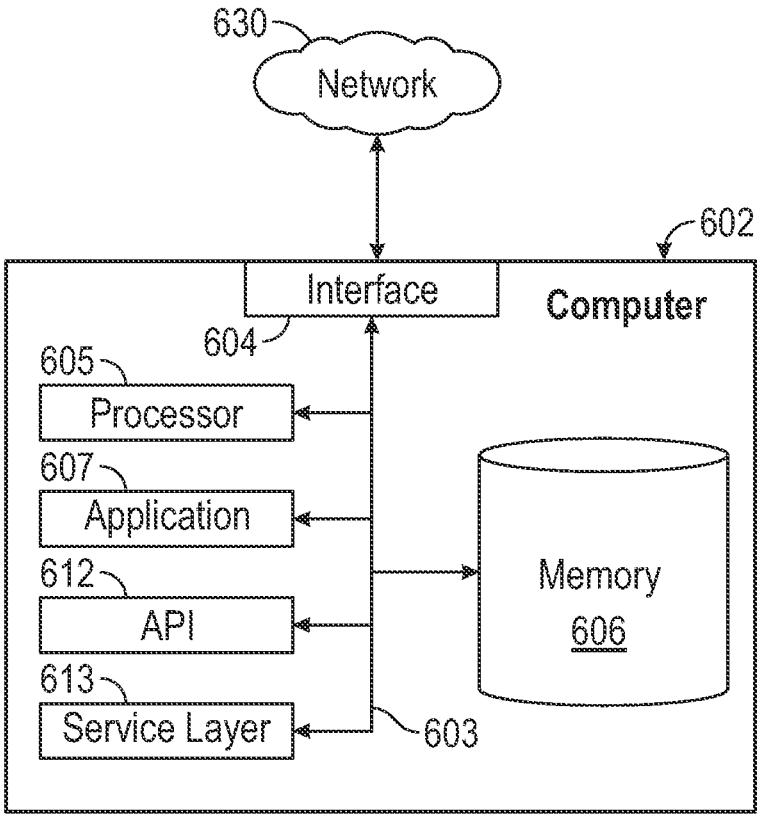
FIG. 6 shows a computer system in accordance with one or more embodiments.

Embodiments may be implemented on a computer system. FIG. 6 is a block diagram of a computer system (602) used to provide computational functionalities associated with described algorithms, methods, functions, processes, flows, and procedures as described in the instant disclosure, according to an implementation. The illustrated computer (602) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (602) may include a computer that includes an input device, such as a keypad, keyboard, touch screen, or other device that can accept user information, and an output device that conveys information associated with the operation of the computer (602), including digital data, visual, or audio information (or a combination of information), or a GUI.

The computer (602) can serve in a role as a client, network component, a server, a database or other persistency, or any other component (or a combination of roles) of a computer system for performing the subject matter described in the instant disclosure. The illustrated computer (602) is communicably coupled with a network (630). In some implementations, one or more components of the computer (602) may be configured to operate within environments, including cloud-computing-based, local, global, or other environment (or a combination of environments).

At a high level, the computer (602) is an electronic computing device operable to receive, transmit, process, store, or manage data and information associated with the described subject matter. According to some implementations, the computer (602) may also include or be communicably coupled with an application server, e-mail server, web server, caching server, streaming data server, business intelligence (BI) server, or other server (or a combination of servers).

The computer (602) can receive requests over network (630) from a client application (for example, executing on another computer (602)) and responding to the received requests by processing the said requests in an appropriate software application. In addition, requests may also be sent to the computer (602) from internal users (for example, from a command console or by other appropriate access method), external or third-parties, other automated applications, as well as any other appropriate entities, individuals, systems, or computers.

Each of the components of the computer (602) can communicate using a system bus (603). In some implementations, any or all of the components of the computer (602), both hardware or software (or a combination of hardware and software), may interface with each other or the interface (604) (or a combination of both) over the system bus (603) using an application programming interface (API) (612) or a service layer (613) (or a combination of the API (612) and service layer (613). The API (612) may include specifications for routines, data structures, and object classes. The API (612) may be either computer-language independent or dependent and refer to a complete interface, a single function, or even a set of APIs. The service layer (613) provides software services to the computer (602) or other components (whether or not illustrated) that are communicably coupled to the computer (602). The functionality of the computer (602) may be accessible for all service consumers using this service layer. Software services, such as those provided by the service layer (613), provide reusable, defined business functionalities through a defined interface. For example, the interface may be software written in JAVA, C++, or other suitable language providing data in extensible markup language (XML) format or other suitable format. While illustrated as an integrated component of the computer (602), alternative implementations may illustrate the API (612) or the service layer (613) as stand-alone components in relation to other components of the computer (602) or other components (whether or not illustrated) that are communicably coupled to the computer (602). Moreover, any or all parts of the API (612) or the service layer (613) may be implemented as child or sub-modules of another software module, enterprise application, or hardware module without departing from the scope of this disclosure.

The computer (602) includes an interface (604). Although illustrated as a single interface (604) in FIG. 6, two or more interfaces (604) may be used according to particular needs, desires, or particular implementations of the computer (602). The interface (604) is used by the computer (602) for communicating with other systems in a distributed environment that are connected to the network (630). Generally, the interface (604 includes logic encoded in software or hardware (or a combination of software and hardware) and operable to communicate with the network (630). More specifically, the interface (604) may include software supporting one or more communication protocols associated with communications such that the network (630) or interface's hardware is operable to communicate physical signals within and outside of the illustrated computer (602).

The computer (602) includes at least one computer processor (605). Although illustrated as a single computer processor (605) in FIG. 6, two or more processors may be used according to particular needs, desires, or particular implementations of the computer (602). Generally, the computer processor (605) executes instructions and manipulates data to perform the operations of the computer (602) and any algorithms, methods, functions, processes, flows, and procedures as described in the instant disclosure.

The computer (602) also includes a memory (606) that holds data for the computer (602) or other components (or a combination of both) that can be connected to the network (630). For example, memory (606) can be a database storing data consistent with this disclosure. Although illustrated as a single memory (606) in FIG. 6, two or more memories may be used according to particular needs, desires, or particular implementations of the computer (602) and the described functionality. While memory (606) is illustrated as an integral component of the computer (602), in alternative implementations, memory (606) can be external to the computer (602).

The application (607) is an algorithmic software engine providing functionality according to particular needs, desires, or particular implementations of the computer (602), particularly with respect to functionality described in this disclosure. For example, application (607) can serve as one or more components, modules, applications, etc. Further, although illustrated as a single application (607), the application (607) may be implemented as multiple applications (607) on the computer (602). In addition, although illustrated as integral to the computer (602), in alternative implementations, the application (607) can be external to the computer (602).

There may be any number of computers (602) associated with, or external to, a computer system containing computer (602), each computer (602) communicating over network (630). Further, the term "client," "user," and other appropriate terminology may be used interchangeably as appropriate without departing from the scope of this disclosure. Moreover, this disclosure contemplates that many users may use one computer (602), or that one user may use multiple computers (602).

In some embodiments, the computer (602) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

obtaining a current measurement of a production rate of a well system;

obtaining a current measurement of a wellhead pressure of the well system;

computing a current smoothed production rate from the current production rate;

computing a current smoothed wellhead pressure from the current wellhead pressure;

forward-predicting, for a time increment, using a machine learning model operating on the current smoothed production rate, the current smoothed wellhead pressure, and the current surface choke size, a future smoothed production rate and a future smoothed wellhead pressure;

computing a change of the future vs the current smoothed production rate;

computing a change of the future vs the current smoothed wellhead pressure;

performing a first test comprising:

comparing the change of the future vs the current smoothed production rate against a first pre-specified threshold production rate derivative, comparing the change of the future vs the current smoothed wellhead pressure against a first pre-specified threshold wellhead pressure derivative;

based on an outcome of the first test:

determining whether a potential future occurrence of sanding is detected; and based on the potential future occurrence of sanding being detected, adjusting a choke configured to control the production rate such that a tendency of sanding is reduced.

2. The method of claim 1, wherein the outcome comprises:

the change of the future vs the current smoothed production rate being a first drop exceeding the first pre-specified threshold production rate derivative, the change of the future vs the current smoothed wellhead pressure being a second drop exceeding the first pre-specified threshold wellhead pressure derivative; and wherein the method further comprises:

based on the outcome, detecting the potential future occurrence of sanding.

3. The method of claim 2, further comprising:

based on detecting the potential future occurrence of sanding:

outputting a message indicating the potential future occurrence of sanding to a user.

4. The method of claim 3, wherein the message comprises at least one selected from the group consisting of the current measurement of the production rate, the current measurement of the wellhead pressure, the future smoothed production rate, and the future smoothed wellhead pressure.

5. The method of claim 1, further comprising:

obtaining a current surface choke size of the well system, wherein performing the first test further comprises determining whether the current surface choke size is above zero.

6. The method of claim 1, wherein the time increment is user-definable.

7. The method of claim 1, further comprising:

training the machine learning model using historical data for the current production rate, the current wellhead pressure, and the current surface choke size.

8. The method of claim 1, wherein the machine learning model is one selected from the group consisting of a multilayer perceptron (MLP), a convolutional neural network (CNN), a recurrent neural network (RNN), and a CNN-RNN hybrid model.

9. The method of claim 1, further comprising:

computing a change of the current smoothed production rate vs a past smoothed production rate;

computing a change of the current smoothed wellhead pressure vs a past smoothed wellhead pressure;

performing a second test comprising:

comparing the change of the current vs the past smoothed production rate against a second pre-specified threshold production rate derivative, comparing the change of the current vs the past smoothed wellhead pressure against a second pre-specified threshold wellhead pressure derivative; and based on an outcome of the second test, determining whether a potential occurrence of sanding is detected.

10. The method of claim 1, further comprising:

predicting a critical drawdown pressure of the well system, based on petrophysical formation evaluation data and mechanical earth model data.

11. A system, comprising:

a flow rate sensor and a pressure sensor disposed at an upper end of a wellbore of a well system;

a choke configured to control a production rate of the well system; and a well monitor configured to:

obtain a current measurement of the production rate of the well system;

obtain a current measurement of a wellhead pressure of the well system;

compute a current smoothed production rate from the current production rate;

compute a current smoothed wellhead pressure from the current wellhead pressure;

forward-predicting, for a time increment, using a machine learning model operating on the current smoothed production rate, the current smoothed wellhead pressure, and the current surface choke size, a future smoothed production rate and a future smoothed wellhead pressure;

compute a change of the future vs the current smoothed production rate;

compute a change of the future vs the current smoothed wellhead pressure;

perform a test comprising:

comparing the change of the future vs the current smoothed production rate against a pre-specified threshold production rate derivative, comparing the change of the future vs the current smoothed wellhead pressure against a pre-specified threshold wellhead pressure derivative; and based on an outcome of the test:

determine whether a potential future occurrence of sanding is detected; and based on the potential future occurrence of sanding being detected, adjust the choke such that a tendency of sanding is reduced.

12. The system of claim 11, wherein the outcome comprises:

the change of the future vs the current smoothed production rate being a first drop exceeding the first pre-specified threshold production rate derivative, the change of the future vs the current smoothed wellhead pressure being a second drop exceeding the first pre-specified threshold wellhead pressure derivative; and wherein the well monitor is further configured to:

based on the outcome, detect the potential future occurrence of sanding.

13. The system of claim 12, wherein the well monitor is further configured to:

based on detecting the potential future occurrence of sanding:

output a message indicating the potential future occurrence of sanding to a user.

14. The system of claim 13, wherein the message comprises at least one selected from the group consisting of the current measurement of the production rate, the current measurement of the wellhead pressure, the future smoothed production rate, and the future smoothed wellhead pressure.

15. The system of claim 11, further comprising:

a choke; and wherein the well monitor is further configured to:

obtain a current surface choke size of the choke, and wherein performing the first test further comprises determining whether the current surface choke size is above zero.

16. The system of claim 11, wherein the well monitor is further configured to:

train the machine learning model using historical data for the current production rate, the current wellhead pressure, and the current surface choke size.

17. The system of claim 11, wherein the machine learning model is one selected from the group consisting of a multilayer perceptron (MLP), a convolutional neural network (CNN), a recurrent neural network (RNN), and a CNN-RNN hybrid model.

18. The system of claim 11, wherein the well monitor is further configured to:

compute a change of the current smoothed production rate vs a past smoothed production rate;

compute a change of the current smoothed wellhead pressure vs a past smoothed wellhead pressure;

perform a second test comprising:

comparing the change of the current vs the past smoothed production rate against a second pre-specified threshold production rate derivative, comparing the change of the current vs the past smoothed wellhead pressure against a second pre-specified threshold wellhead pressure derivative; and based on an outcome of the second test, determine whether a potential occurrence of sanding is detected.

19. The system of claim 11, wherein the well monitor is further configured to:

predict a critical drawdown pressure of the well system, based on petrophysical formation evaluation data and mechanical earth model data.

20. A non-transitory machine-readable medium comprising a plurality of machine-readable instructions executed by one or more processors, the plurality of machine-readable instructions causing the one or more processors to perform operations comprising:

obtaining a current measurement of a production rate of a well system;

obtaining a current measurement of a wellhead pressure of the well system;

computing a current smoothed production rate from the current production rate;

computing a current smoothed wellhead pressure from the current wellhead pressure;

forward-predicting, for a time increment, using a machine learning model operating on the current smoothed production rate, the current smoothed wellhead pressure, and the current surface choke size, a future smoothed production rate and a future smoothed wellhead pressure;

computing a change of the future vs the current smoothed production rate;

computing a change of the future vs the current smoothed wellhead pressure;

performing a test comprising:

comparing the change of the future vs the current smoothed production rate against a pre-specified threshold production rate derivative, comparing the change of the future vs the current smoothed wellhead pressure against a pre-specified threshold wellhead pressure derivative; and based on an outcome of the test;

determining whether a potential future occurrence of sanding is detected; and based on the potential future occurrence of sanding being detected, adjusting a choke configured to control the production rate such that a tendency of sanding is reduced.

* * * * *